US007215186B2

(12) United States Patent
Whyte et al.

(10) Patent No.: US 7,215,186 B2
(45) Date of Patent: May 8, 2007

(54) METHOD FOR OPERATIONAL AMPLIFIER SHARING BETWEEN CHANNELS

(75) Inventors: Andrew Whyte, San Carlos, CA (US); Kevin D'Angelo, Santa Clara, CA (US)

(73) Assignee: Advanced Analogic Technologies, Inc., Sunnyvale, CA (US)

( * ) Notice: Subject to any disclaimer, the term of this patent is extended or adjusted under 35 U.S.C. 154(b) by 45 days.

(21) Appl. No.: 10/907,854

(22) Filed: Apr. 18, 2005

(65) Prior Publication Data

US 2006/0232325 A1 Oct. 19, 2006

(51) Int. Cl.
*G05F 1/10* (2006.01)

(52) U.S. Cl. ..... 327/543; 327/541; 323/316

(58) Field of Classification Search ..... 327/540, 327/541, 543; 323/316
See application file for complete search history.

(56) References Cited

U.S. PATENT DOCUMENTS 4,864,216 A * 9/1989 Kalata et al. ..... 323/315
5,335,203 A * 8/1994 Ishii et al. ..... 365/226
5,506,541 A * 4/1996 Herndon ..... 327/541
6,011,428 A * 1/2000 Tsukude et al. ..... 327/541
6,078,210 A * 6/2000 Uchida et al. ..... 327/530
2006/0082412 A1* 4/2006 D'Angelo et al. ..... 327/541

* cited by examiner

*Primary Examiner*—Long Nguyen
*Assistant Examiner*—Ryan C. Jager

(57) ABSTRACT

A multi-channel current regulator includes two or more channels, each channel acting as a current source or sink for a respective load. Each channel regulates its load current so that the load current is proportional to an input voltage supplied to the channel. An operational amplifier is shared between the channels. Each channel is selected in a rotating sequence for connection to the amplifier. As each channel is selected, a two-phase refresh cycle is initiated. During the first phase, the output of the amplifier is charged until it substantially matches the drive voltage of the selected channel. This is followed by the second phase where the output of the amplifier is adjusted until the load current of the selected channel is proportional to a set voltage $V_{set}$.

15 Claims, 2 Drawing Sheets

METHOD FOR OPERATIONAL AMPLIFIER SHARING BETWEEN CHANNELS

BACKGROUND OF THE INVENTION

Current sources and current sinks are commonly used to provide regulated currents in circuits of all types. As shown in FIG. 1A, a current sink can be constructed as a combination of a sense resistor, a MOSFET and an operational amplifier. The operational amplifier adjusts the voltage at the gate of the MOSFET to minimize the voltage difference between the inputs of the op amp. In a perfect system, the voltage at the source of the MOSFET, $V_s$, equals the voltage on the positive terminal of the amplifier, $V_{set}$, and the current is given by $I=V_{set}/R$. FIG. 1B shows a current source constructed using a similar combination of components.

For some applications, it is desirable to use a series of current sinks or sources driven using the same set voltage, $V_{set}$. In an arrangement of this type, each current sink or current source defines a separate channel for current flowing to ground. For the currents in each channel to be equal, all duplicated elements must exactly match in value and characteristics. Unfortunately, mismatches inevitably result because manufacturing variations are unavoidable. Though mismatch between sense-resistors can be minimized with careful layout, random offset within each amplifier is more difficult to correct and can contribute directly to mismatch between channel currents. In fact, random offset is often the main contributor to mismatch—particularly where R is small since $I=V_{set}/R+V_{OS}/R$. Consider for example, a hypothetical low power implementation where R is 2 Ohms. If $V_{os}$ is in the range of −10 mV to 10 mV, then $V_{OS}/R$ can be as large as 5 mA. This would be significant for the case where $V_{set}/R$ is 20 mA (which would not be unusual for low power devices).

For this reason, U.S. patent application Ser. No. 10/970,061 (incorporated in this document by reference) describes a method for sharing a single operational amplifier between a series of channels. As shown in FIG. 2, this method uses two multiplexers. The first allows the output of an operational amplifier to be switched between channels. The second multiplexer allows the feedback voltage to the operational amplifier to be switch in the same fashion. The overall result is that the operational amplifier is shared, with each channel being selected in a (typically) rotating sequence. A problem encountered with this method arises because the operational amplifier takes time to adapt as it is switched between channels. If two channels are operating at significantly different values, regulation of the channel selected second will be bobbled as the operational amplifiers adapts to conditions of the second channel. The second channel starts with the conditions from the previous channel and then the current has to be changed to the final desired value.

SUMMARY OF THE INVENTION

The present invention includes a pre-charge method for amplifier sharing for multi-channel current sink and current sources. For a representative embodiment, a series of current sinks are controlled using a single operational amplifier. Each current sink includes a MOSFET connected through a sense resistor to ground. A feedback sense node is defined for each current sink as the voltage over the sense resistor. The voltage at the feedback sense node is proportional to the current flowing through the MOSFET. That current is used to drive a load, such as an LED.

For a typical implementation of the pre-charge method, each channel is selected in sequence (e.g., Channel A followed by Channel B, followed by Channel C, followed by Channel A, etc.). As each channel is selected, a two-phase refresh cycle is initiated. During the first phase of the refresh cycle, the amplifier is set into a state that is close to the actual operating condition of the selected channel, before it is used to drive that channel. This is accomplished by first setting the amplifier into a unity gain configuration, with its positive input being driven by the gate of the selected channel MOSFET and its holding capacitor. During the second phase of the refresh cycle, the amplifier is used to adjust the current flowing through the selected channel to a desired level.

Two multiplexers are used to perform channel selection (M1 and M2). As each channel is selected, these multiplexers are configured to:

(1) connect the selected channel's current sense node to a node S (by operation of M1); and (2) connect the selected channel's MOSFET gate to a node G (by operation of M2).

An additional two multiplexers (M3 and M4) and a switch (SW1) are used to implement the two-phase refresh cycle. For the first phase of the refresh cycle, the switch and the multiplexers M3 and M4 are configured to:

(1) disconnect the output of the operational amplifier from the node G (by operation of SW1);

(2) connect the negative input of the amplifier to its output (by operation of M3); and (3) connect the positive input of the amplifier to the node G (by operation of M4).

For the second phase of the refresh cycle, the switch and the multiplexers M3 and M4 are configured to:

(1) connect the output of the operational amplifier to the node G (by operation of SW1);

(2) connect the negative input of the amplifier to the node S (by operation of M3); and (3) connect the positive input of the amplifier to the set voltage $V_{set}$ (by operation of M4).

In practice, the use of the two-phase refresh cycle minimizes current variations as the operational amplifier is switched between channels.

DETAILED DESCRIPTION OF THE PREFERRED EMBODIMENTS

Figure 3:
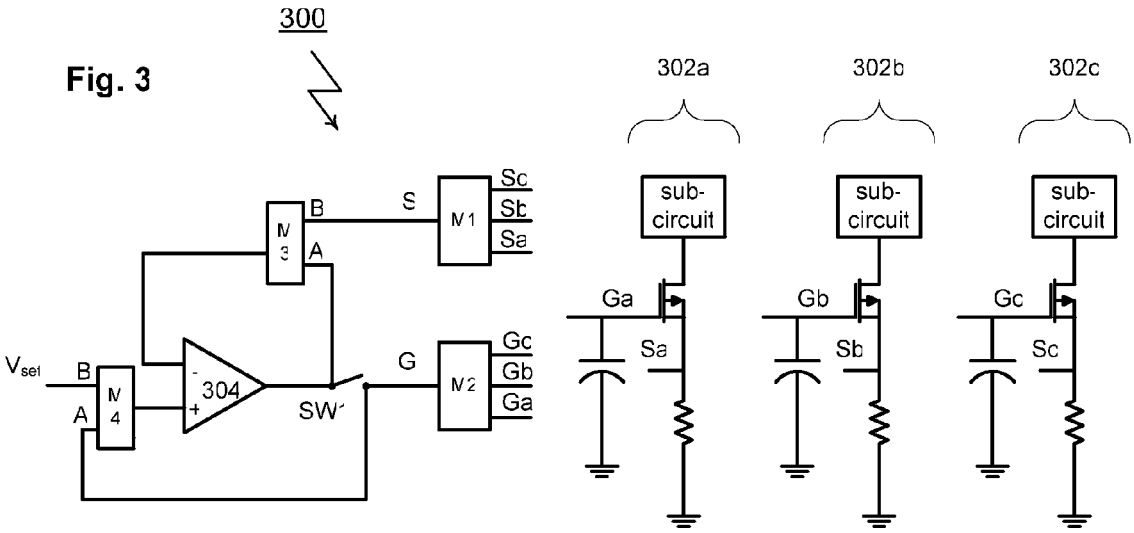
FIG. 3 is a block diagram of a multi-channel current sink as provided by an embodiment of the present invention.

The present invention includes a pre-charge method for amplifier sharing in multi-channel current sink and current sources. FIG. 3 shows a representative embodiment of a multi-channel current sink 300 that implements the pre-charge method. As shown in FIG. 3, multi-channel current sink 300 includes a series of three separate channels, labeled 302*a* through 302*c*. The number of channels 302 is entirely implementation dependent and can be more or less than the three shown. Each channel includes a sense resistor and a MOSFET. Each channel 302 also includes an optional capacitor which helps maintain its MOSFET gate voltage between refresh cycles. Channels 302 regulate current for associated sub-circuits which may be, for example white LEDs. The sub-circuits may also be the respective elements of an RGB LED or any other type of circuit that requires current regulation.

Channels 302 are selected in a (typically) rotating sequence. For the three channel implementation shown, channel 302*a* would typically be selected, followed by channel 302*b*, channel 302*c* and back to channel 302*a*. It should be appreciated that other selection strategies and algorithms may also be used. Multiplexers M1 and M2 are used to perform channel selection. To select a channel 302, multiplexer M1 is used to connect the channel's current sense node to a node S. Multiplexer M2 is used to connect the channel's MOSFET gate to a node G. A variable shift register (not shown) is typically used to control the channel selection by multiplexers M1 and M2. The shift register is preferably configured to skip over any channel that has been disabled and refresh only those channels that are intended to conduct current. Typically, this is accomplished using a second register that includes one enable/disable bit per channel. To prevent current flow, it is preferable to ground the gates of all disabled channels.

Multi-channel current sink 300 also includes an operational amplifier 304. As each channel 302 is selected, a two-phase refresh cycle is initiated. During the first phase of the refresh cycle, amplifier 304 is set into a state that is close to the actual operating condition of the selected channel 302, before it is used to drive that channel 302. This is accomplished by first setting amplifier 304 into a unity gain configuration, with its positive input being driven by the gate of the selected channel 302 and its holding capacitor. During the second phase of the refresh cycle, amplifier 304 is used to adjust the current flowing through the selected channel 302 to a desired level.

Figure 4A:
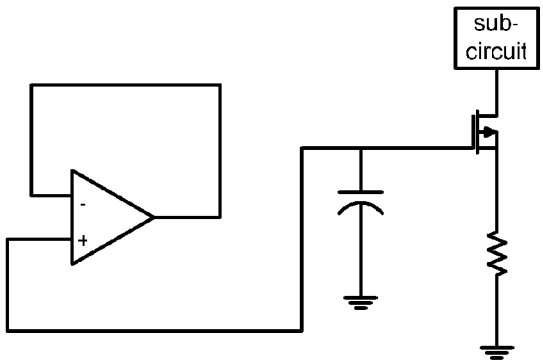
FIG. 4A is a block diagram showing a circuit established during the first part of the two-phase refresh cycle provided by the present invention.

Multiplexers (M3 and M4) and a switch (SW1) are used to implement the two-phase refresh cycle. For the first phase of the refresh cycle, switch SW1 is opened and multiplexers M3 and M4 are configured to select their "A" inputs. The result is the circuit shown in FIG. 4A. In that circuit:

(1) the output of amplifier 304 is connected to the negative input of amplifier 304; and (2) the positive input of amplifier 304 is connected to the node G (i.e., the gate of the MOSFET of the selected channel 302).

This circuit is maintained for a period of time (approximately 4 uS for current implementations), allowing the output of amplifier 304 output to charge to the gate voltage of the selected channel 302 (also referred to as pre-charging of operational amplifier 304). For the second phase of the refresh cycle, switch SW1 is closed and the M3 and M4 are configured to select their "B" inputs. The result is the circuit shown in FIG. 4B. In that circuit:

(1) the output of amplifier 304 is connected to node G (i.e., the gate of the MOSFET of the selected channel 302);

(2) the negative input of amplifier 304 is connected to the node S (i.e., the current sense node of the selected channel 302); and (3) the positive input of amplifier 304 is connected to the set voltage $V_{set}$.

To avoid charge injection and allow the circuit to operate as intended the switch SW1 and Multiplexers M1–M4 are sequence in a specific order:

(1) SW1 is opened, (2) M3 and M4 are changed to the "A" setting, (3) M1 and M2 are shifted to the next channel to be refreshed, (4) Pre-charging of operational amplifier 304 occurs, (5) M3 and M4 are changed to the "B" setting, (6) SW1 is closed, and (7) The operational amplifier adjusts the current in the selected channel based on the set voltage $V_{set}$.

A small break before make time is set between settings on M3 and M4.

Figure 4B:
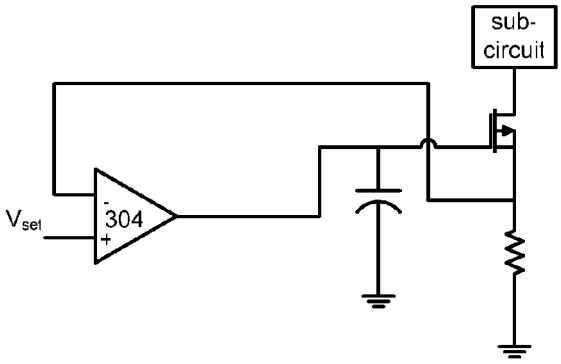
FIG. 4B is a block diagram showing a circuit established during the second part of the two-phase refresh cycle provided by the present invention.

The circuit shown in FIG. 4B is maintained until the current in the selected channel matches the target set by the set voltage $V_{set}$. The duration of time in which the circuit of FIG. 4B is maintained may also be varied to change the duty cycle for the selected channel 302. This can be used, for example where the sub-circuits are elements of an RGB LED and the duty cycle of each element is determined by a color to be displayed (i.e., field sequential display). For applications of this type, where only a single channel is active at a given time, it is possible to use a single sense resistor that is shared between channels.

Figure 1A:
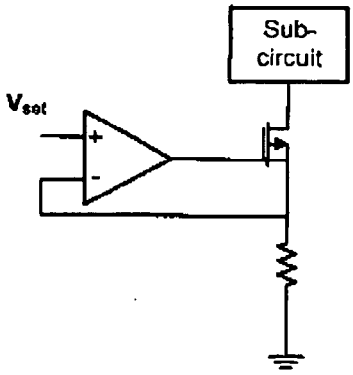
Fig. 1A (Prior Art)
FIG. 1A is a block diagram of a prior art current sink.
Figure 1B:
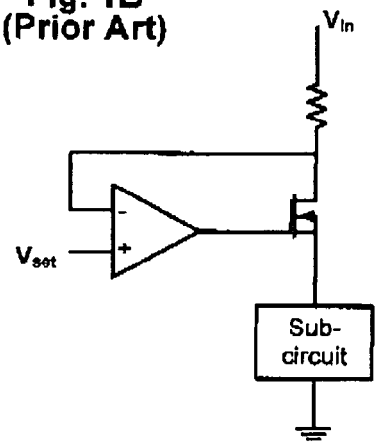
Fig. 1B (Prior Art)
FIG. 1B is a block diagram of a prior art current source.
Figure 2:
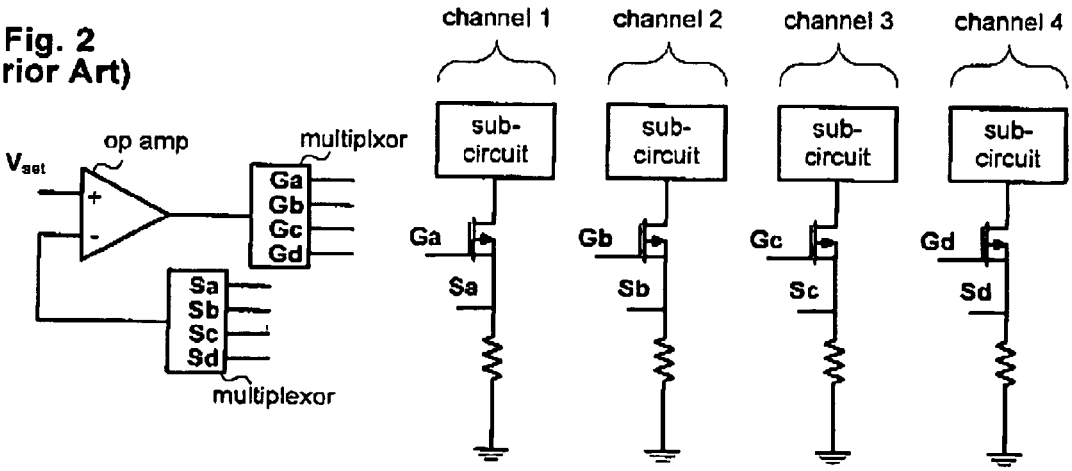
Fig. 2 (Prior Art)
FIG. 2 is a block diagram of a multi-channel current sink.

The implementations described above are based, in part on the current sink topology of FIG. 1A. It should be noted, however that the same techniques may be used with current sources. The implementations are also based on the use of MOSFET technology. It should be noted, however that other transistor types may be used including bipolar transistors (typically with different holding capacitors).

What is claimed is:

1. A multi-channel current regulator that comprises:

two or more channels, each channel configured to regulate a load current so that the load current is proportional to a drive voltage for the channel;

an operational amplifier;

a switching network for selecting each channel in a repeating sequence, the switching network performing a refresh cycle for each selected channel; the refresh cycle including:

a first phase where the output of the operational amplifier is charged until it substantially matches the drive voltage of the selected channel; and a second phase where the output of the operational amplifier is adjusted until the load current of the selected channel is proportional to a set voltage Vset.

2. A multi-channel current regulator as recited in claim 1 in which each channel acts as a current sink for its load current.

3. A multi-channel current regulator as recited in claim 1 in which each channel acts as a current source for its load current.

4. A multi-channel current regulator as recited in claim 1 in which the switching network establishes a circuit during each first phase in which:

the output of the operational amplifier is connected to the negative input of the amplifier; and the positive input of the operational amplifier is connected to the drive voltage for the selected channel.

5. A multi-channel current regulator as recited in claim 1 in which the switching network establishes a circuit during each second phase in which:

the output of the operational amplifier is connected to supply the drive voltage of the selected channel;

the negative input of the operational amplifier is connected to a feedback voltage that is proportional to the load current of the selected channel; and the positive input of the operational amplifier is connected to the set voltage Vset.

6. A multi-channel current regulator as recited in claim 1 that further comprises a shift register configured to cause each channel to be selected in the repeating sequence.

7. A multi-channel current regulator as recited in claim 1 in which each channel is connected to act as a current source or current sink for an element of a RGB LED.

8. A multi-channel current regulator as recited in claim 7 that further Comprises a circuit for varying the duty cycle of each selected channel.

9. A method for controlling a series of two or more channels, where each channel is configured to regulate a load current so that the load current is proportional to a drive voltage for the channel, the method comprising:

selecting each channel from the series in a repeating sequence;

performing a refresh cycle for each selected channel; the refresh cycle including:

charging an operational amplifier until the output of the amplifier substantially matches the drive voltage of the selected channel; and adjusting the output of the operational amplifier until the load current of the selected channel is proportional to a set voltage Vset.

10. A method as recited in claim 9 in which each channel acts as a current sink for its load current.

11. A method as recited in claim 9 in which each channel acts as a current source for its load current.

12. A method as recited in claim 9 that further comprises:

connecting the output of the operational amplifier to the negative input of the amplifier; and connecting the positive input of the operational amplifier to the drive voltage for the selected channel.

13. A method as recited in claim 9 that further comprises:

connecting the output of the amplifier to supply the drive voltage of the selected channel;

connecting the negative input of the operational amplifier to a feedback voltage that is proportional to the load current of the selected channel; and connecting the positive input of the operational amplifier to the set voltage Vset.

14. A method as recited in claim 9 in which each channel is connected to act as a current source or current sink for an element of a RGB LED.

15. A method as recited in claim 14 that further comprises varying the duty cycle of each selected channel.

* * * * *